US006138747A

United States Patent [19]

Kroger et al.

[11] Patent Number: 6,138,747

[45] Date of Patent: Oct. 31, 2000

[54] HEAT EXCHANGER TUBE TO HEADER SWAGING PROCESS

[75] Inventors: Dale Lewis Kroger; Kevin Kent Stahlecker, both of Canton, S. Dak.; Les Dean VanDenTop, Rock Valley, Iowa; Adeel Zaidi, Sioux Falls, S. Dak.

[73] Assignee: Dehr Heat Transfer System, Inc., Canton, S. Dak.

[21] Appl. No.: 09/251,886

[22] Filed: Feb. 17, 1999

[51] Int. Cl.[7] ..... F28F 9/04

[52] U.S. Cl. ..... 165/158; 29/890.044

[58] Field of Search ..... 165/158, 159, 165/160, 161, 162; 29/890.044

[56] References Cited

U.S. PATENT DOCUMENTS

| | | | |
|---|---|---|---|
| 784,192 | 3/1905 | Throop . | |
| 1,250,881 | 12/1917 | Hodges . | |
| 1,988,418 | 1/1935 | German . | |
| 2,411,097 | 11/1946 | Kopp | 165/158 |
| 2,596,233 | 5/1952 | Gardner | 165/158 X |
| 2,754,573 | 7/1956 | Schoessow . | |
| 4,152,818 | 5/1979 | Mort et al. | 29/890.044 |
| 4,207,944 | 6/1980 | Holtz et al. | 165/82 |
| 4,234,041 | 11/1980 | Melnyk | 165/173 |
| 4,459,917 | 7/1984 | Michael et al. | 165/151 |
| 4,528,733 | 7/1985 | Lord | 29/157 |
| 4,584,765 | 4/1986 | Gray | 29/727 |
| 4,682,650 | 7/1987 | Potier | 165/173 |
| 4,884,629 | 12/1989 | Bronnert | 165/159 |
| 5,067,235 | 11/1991 | Kato et al. | 29/890 |
| 5,099,677 | 3/1992 | Tokura | 72/456 |
| 5,381,600 | 1/1995 | Patel | 29/890 |

*Primary Examiner*—Allen Flanigan
*Attorney, Agent, or Firm*—Howard & Howard

[57] ABSTRACT

A method for making a heat exchanger assembly (10) includes inserting tubes (20) through fin holes (32) in heat exchanger fins (30) and headers (40, 42) to form a bundle (50), and expanding the tubes (20) forming an interference fit with the heat exchanger fins (30). The bundle (50) is inserted into a housing (60) open at both ends (67, 68) and having a wall (62) surrounding the headers (40, 42) with inlet and outlet lines (64, 66) in the wall (62), and sealing the wall (62) of the housing (60) to the first and second headers (40, 42) with the inlet and outlet lines (64, 66) disposed between the headers (40, 42). A plurality of mandrel heads (70) are inserted through the open ends (67, 68) of the housing (60) into the tubes (20) expanding the tubes (20) into the headers (40, 42) to form a sealed joint between the tubes (20) and the headers (40, 42). The headers (40, 42) are disposed in an axial overlapping relationship with the first and second open ends (67, 68) of the housing (60) of each header extends axially from the open ends (67, 68). A pair of caps (80) close the open ends (67, 68) of the housing (60) and are disposed in axial overlapping relationship with the portion of the headers (40, 42) extending out of the housing (60).

6 Claims, 2 Drawing Sheets

HEAT EXCHANGER TUBE TO HEADER SWAGING PROCESS

BACKGROUND OF THE INVENTION

1) Technical Field

A method for making a heat exchanger.

2) Description of the Prior Art

The manufacture of tube and bundle style heat exchangers require sealing joints formed between tubes and headers to prevent fluid from passing through the joint. The sealing is widely accomplished by expanding the tube, which is typically a malleable material, into the header substrate causing the tube to form to the header surface profile. The tube expansion is widely performed by tube rolling which requires the use of a tube roller. A tube roller includes a thrust collar for preventing over-inserting the tube roller into the tube being expanded. The thrust collar prevents expanding more than one tube at a time due to its width and the close proximity of the header holes.

SUMMARY OF THE INVENTION AND ADVANTAGES

A method for making a heat exchanger by simultaneously expanding a plurality of tubes. The method includes inserting tubes through holes in heat exchanger baffles and headers to form a bundle, and expanding the tubes forming an interference fit with the heat exchanger baffles. The bundle is inserted into a housing open at both ends having a wall surrounding the headers with inlet and outlet lines in the wall. The wall of the housing is sealed to the first and second headers with the inlet and outlet lines disposed between the headers. A plurality of the mandrel heads is inserted through the open ends of the housing and into the tubes expanding the tubes into the headers forming a sealed joint between the tubes and the headers.

The use of a mandrel head having a narrow shaft facilitates the use of multiple mandrels which allows swaging all of the tubes simultaneously. The swaging of tubes in this fashion significantly reduces the process time required to form the joints between the tubes and the header. In addition, tool replacement costs are greatly reduced. The entire tube roller must be replaced when the roller surface is worn whereas only the mandrel must be replaced when the mandrel head is worn. Also, a mandrel head used in the manner described above will last up to seven times longer than a tube roller reducing replacement frequency.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
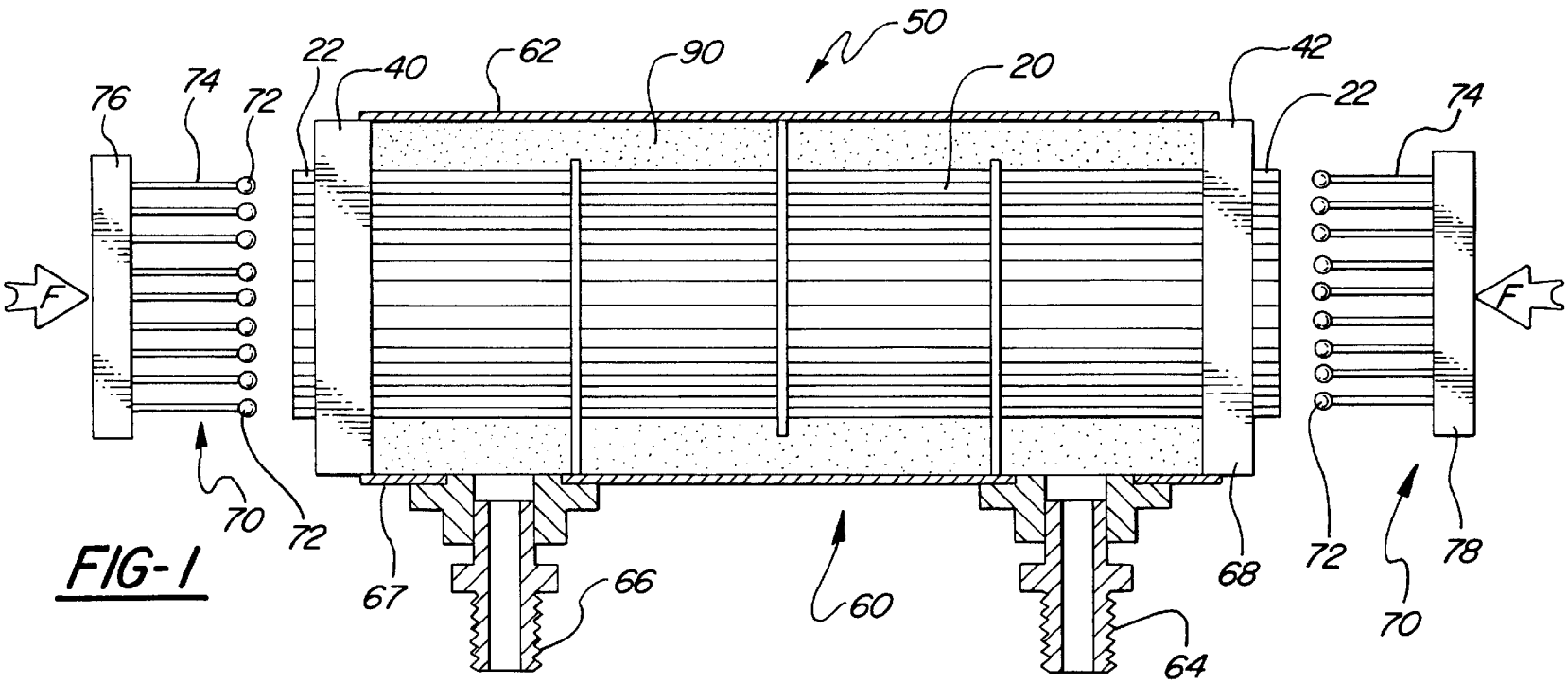
FIG. 1 is a side elevation showing a heat exchanger bundle aligned for swaging.
Figure 3:
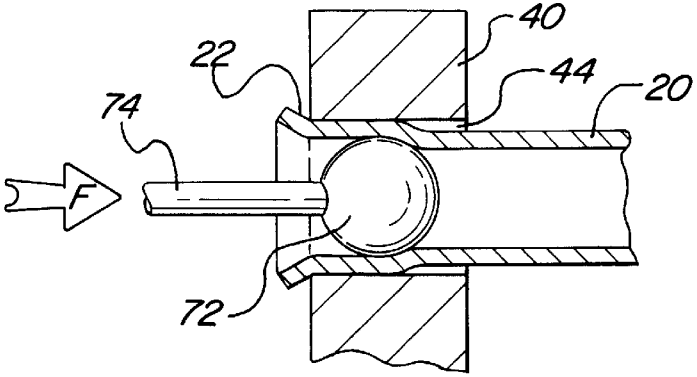
FIG. 3 is an illustration of a tube end being swaged to form a joint with a header.
Figure 2:
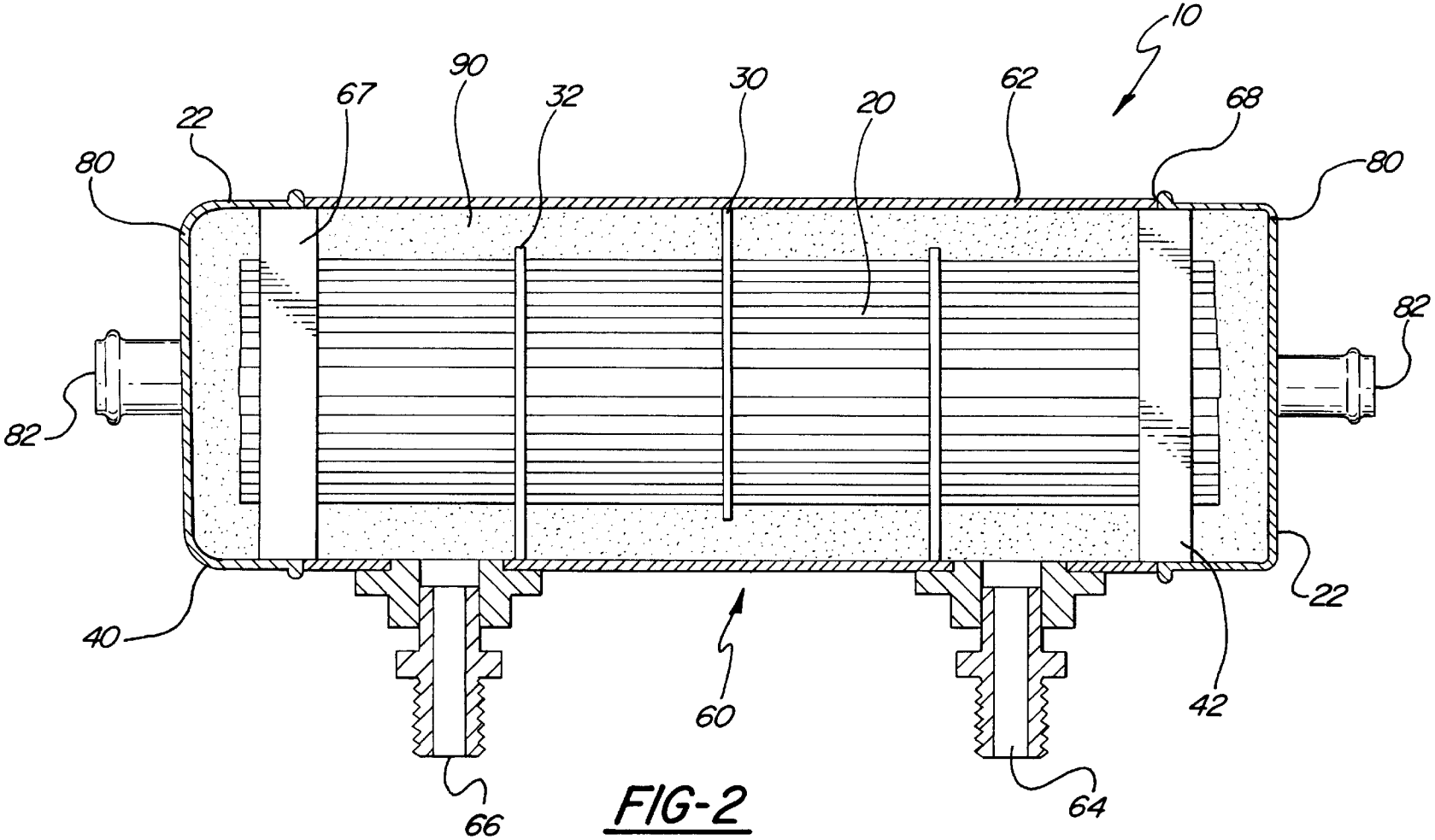
FIG. 2 is a side elevation showing a heat exchanger assembly.

Referring to the Figures, wherein like numerals indicate like or corresponding parts throughout the several views, a heat exchanger assembly generally shown at 10 includes heat exchanger baffles 30 having aligned fin holes 32. A plurality of tubes 20 extending though the baffle holes 32 in the heat exchanger baffles 30 to form a subassembly with the heat exchanger baffles 30 spaced apart along the length of the tubes 20. As is well known in the art, fins are dispersed between the baffles 30. A first header 40 defines header holes 44 aligned with the baffle holes 32 with the tube ends 22 inserted through the header holes 44 forming a bundle 50. A second header 42 defining header holes 44 aligned with the baffle holes 32 has opposite tube ends 22 inserted into header holes 44.

A method for making the heat exchanger includes the first step of inserting the tubes 20 through the baffle holes 32 in the heat exchanger baffles 30 and the header holes 44 in the headers 40,42 to form a bundle 50, and expanding the tubes 20 forming an interference fit with the heat exchanger baffles 30. For example, the tubes 20 can be expanded by inserting and operating a mandrel drive in a conventional manner. The interference fit between the tubes 20 and the holes in the heat exchanger baffles 30 secure the baffles 30 to the tubes 20 during the assembly process and enhance the heat transfer between the fluid inside the tubes 20 and the fluid outside the tubes 20 by increasing the heat transfer surface area as is known in the art.

The bundle 50 is inserted into a housing generally shown at 60 which is open at both ends 67,68 and defines a wall 62 surrounding the headers 40,42 with inlet and outlet lines 64,66 in the wall 62. Thus, the bundle 50 is enclosed in the housing 60 having the wall 62 surrounding the header with open first and second ends 67,68. The wall 62 of the housing 60 includes the inlet line 64 and the outlet line 66.

The wall 62 of the housing 60 is subsequently sealed to the first and second headers 40,42 having the inlet and outlet lines 64,66 disposed between the headers 40,42. Any means can be used to seal the housing 60 to the headers 40,42, including welding. The seal secures the headers 40,42 to the housing 60 preventing the headers 40,42 from moving during the swaging process discussed below. The first header 40 is disposed in an axial overlapping relationship with the first open end 67 whereby a portion of the first header 40 extends axially from the first open end 67. The assembly 10 includes a second header 42 in an axially overlapping relationship with the second open end 68 whereby a portion of the second header 42 extends axially from the second open end 68. In other words, each header 40,42 has a portion inside the housing and a portion outside the housing. Each header is sealed to the corresponding open end of the housing 60 to create a fluid tight chamber 90.

The chamber 90 is completed by inserting a plurality of the mandrel heads generally shown at 70 through the open ends 67,68 of the housing 60 and into the tubes 20 expanding the tubes 20 into the headers 40,42 with the mandrel heads 70 to form a sealed joint between the tubes 20 and the headers 40,42. The tube 20 expansion is performed by swaging the tubes 20 by forcing the mandrel heads 70 into the tubes 20 causing the tubes 20 to enlarge.

The swaging process is performed by a swaging machine having a first and second plate 76,78 located opposite each other, each having a plurality of mandrel heads 70 attached. Each mandrel head includes a spherical tip 72 at the end of a shaft 74 which is connected to one of the plates 76,78. The mandrel heads 70 connected to the first plate 76 point towards the mandrel heads 70 connected to the second plate 78. The heat exchanger chamber 90 rests on a cradle located between the mandrel heads 70 during the swaging process.

Simultaneously, the mandrel heads 70 are forced into the tubes 20 causing the tubes 20 to expand into the headers 40,42. Copper tubes 20 are contemplated, but not to the exclusion of other appropriate mailable materials. The joint formed by the swaging process is fluid tight do to the expansion of the tubes 20 into the header when the tubes 20 take the shape of the header at the tube/header interface. For example, when viewed under magnification, the tube 20 material can be seen to have completely conformed to the rough surface finish of the header hole 44.

The mandrel heads 70 include a spherical tip 72 having a diameter greater than the inside diameter of the tubes 20 causing an interference fit between the mandrel heads 70 and the tubes 20 as is known in the art of swaging. The interference fit is determined by the following formula:

$$\text{Interference}=\text{Headsheet Dia.}-2\times\text{tube wall}-\text{Tool Dia.}$$

For example, dimensions that are contemplated include a header hole 44 having 0.203" nominal diameter, a tube 20 wall thickness of 0.014" nominal and a mandrel head 70 diameter of 0.180" would create the following interference condition:

$$\text{Interference}=0.203''-2\times(0.014'')-0.180''=0.005''$$

The tube 20 swaging is limited to expanding the tubes 20 only part way through each of the first and second headers 40,42. For the dimensions contemplated above, the insertion depth of the mandrel head 70 would be 0.05" less than the thickness of the headers 40,42.

A first cap 80 closes the first open end 67 of the housing 60 and is disposed in axial overlapping relationship with that portion of the first header 40 extending out of the housing 60. A second cap 80 closes the second open end 68 of the housing 60 and is disposed in axial overlapping relationship with that portion of the second header 42 extending out of the housing 60. During assembly, each cap 80 with a fluid line 82 therein is placed over the open ends 67,68 of the housing 60 with the caps 80 overlapping the axial portion of each header extending out of the housing 60.

A joint is formed between the first and second caps 80 and the housing 60 in an overlapping relationship with the first and second headers 40,42. These joints are is welded to seal the heat exchanger. The fabrication is completed when the caps 80 are sealed to the housing 60. Each cap 80 includes a fluid line 82 therein.

When operating, fluid entering the fluid line 82 in the first cap 80 will exit the fluid line 82 in the second cap 80 after traveling though the inside diameter of the tubes 20. Fluid exiting and entering the caps 80 will be prevented from entering the chamber 90 by the welded joint formed between the caps 80, the header, and the housing wall 62, and by the swaged joint formed between the tubes 20 and the headers 40,42. Likewise, fluid entering and exiting through the lines in the housing wall 62 is prevented from entering the inside diameter of the tubes 20.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A heat exchanger assembly (10) comprising:

heat exchanger baffles (30) having aligned baffle holes (32), and tubes (20) extending through said baffle holes (32) in said heat exchanger baffle (30) and forming a subassembly with said heat exchanger baffles (30) spaced apart along the length of said tubes (20), and a first header (40) having header holes (44) aligned with said baffle holes (32), said header holes being substantially uniform in diameter throughout the thickness of the header, said tube ends (22) being inserted through said header holes (44), said tube ends (22) being expanded into larger cross sections only part way through said header holes (44) of said first header (40), a housing (60) having a wall (62) surrounding said header with open first and second ends (67,68), said header disposed in an axial overlapping relationship with said first open end (67) whereby a portion of said first header (40) extends axially from said first open end (67), and a cap (80) closing said first open end (67) of said housing (60) and disposed in axial overlapping relationship with said portion of said first header (40) extending out of said housing (60).

2. An assembly (10) as set forth in claim 1 including a second header (42) in an axially overlapping relationship with said second open end (68) whereby a portion of said second header (42) extends axially from said second open end (68).

3. An assembly (10) as set forth in claim 2 including a second cap (80) closing said second open end (68) of said housing (60) and disposed in axial overlapping relationship with said portion of said second header (42) extending out of said housing (60).

4. An assembly (10) as set forth in claim 3 wherein a joint formed between said first and second caps (80) and said housing (60) in an overlapping relationship with said first and second headers (40,42) is welded.

5. An assembly (10) as set forth in claim 2 wherein each of said caps (80) include a fluid line (82) therein.

6. An Assembly (10) as set forth in claim 1 wherein said wall (62) of said housing (60) includes a fluid inlet line and a fluid outlet line.

* * * * *